US005586806A

United States Patent [19]

Hergott

[11] Patent Number: 5,586,806

[45] Date of Patent: Dec. 24, 1996

[54] UNDERSEAT ARTICLE HOLDER APPARATUS

[75] Inventor: Arthur Hergott, Deerfield, Ill.

[73] Assignee: Greenwich Industries, L.P., Lake Bluff, Ill.

[21] Appl. No.: 561,437

[22] Filed: Nov. 21, 1995

[51] Int. Cl.[6] ..... A47C 7/62

[52] U.S. Cl. ..... 297/188.11; 297/188.21; 297/331

[58] Field of Search ..... 297/188.01, 188.08, 297/188.09, 188.1, 188.11, 188.15, 188.17, 188.21, 331; 248/311.2; 5/58; 312/235.2, 330.1; 224/275

[56] References Cited

U.S. PATENT DOCUMENTS

| | | | |
|---|---|---|---|
| 834,988 | 11/1906 | Mallory | 297/188.11 |
| 2,652,887 | 9/1953 | Fitzgerald | 297/288.11 |
| 2,812,227 | 11/1957 | Hill | 297/188.1 X |
| 3,026,141 | 3/1962 | Welles | 297/188.11 |
| 3,189,380 | 6/1965 | Reguitti | 297/188.1 X |
| 3,290,089 | 12/1966 | Farrell | 297/188.1 X |
| 3,494,661 | 4/1968 | Leyburn | 297/188 |
| 4,061,395 | 12/1977 | Boole | 297/188.11 |
| 4,341,418 | 7/1982 | Chappell | 297/192 |
| 4,500,059 | 2/1985 | Papizan | 248/205 |
| 4,556,250 | 12/1985 | Chapman et al. | 297/192 |
| 4,715,652 | 12/1987 | Ward | 297/252 |
| 4,799,731 | 1/1989 | Brown | 297/192 |
| 4,887,379 | 12/1989 | Harrison | 43/54 |
| 4,957,227 | 9/1990 | Trimble | 224/39 |
| 4,971,390 | 11/1990 | McGinley | 297/188.11 |
| 5,035,464 | 7/1991 | Spallholtz | 297/188.08 X |
| 5,060,899 | 10/1991 | Lorence et al. | 297/188.01 X |
| 5,188,442 | 2/1993 | Harty et al. | 297/188.11 |
| 5,306,071 | 4/1994 | Zamo' et al. | 297/192 |

*Primary Examiner*—Milton Nelson, Jr.
*Attorney, Agent, or Firm*—Fitch, Even, Tabin & Flannery

[57] ABSTRACT

There is provided an article holder apparatus for use with a seating assembly, such as a chair. In the preferred embodiment, the article holder assembly includes a mounting plate for attachment to the underside of the chair's seat. At least one guide is mounted to the mounting plate to support a carriage at a location adjacent the mounting plate for movement in a first path. The carriage carries an article holder supported for movement in a second path transverse to the first path. The article holder includes an article receiver to hold the article. The article holder assembly may be used with existing seating assemblies.

22 Claims, 5 Drawing Sheets

UNDERSEAT ARTICLE HOLDER APPARATUS

FIELD OF THE INVENTION

The present invention relates generally to an article holder apparatus for use in conjunction with a seating assembly and, more particularly, to an article holder apparatus that attaches to the underside of the seat portion of the seating assembly to hold articles, such as beverage containers and the like.

BACKGROUND OF THE INVENTION

In stadiums, auditoriums and the like, there are typically areas set with seating arrangements which contain a number of chairs arranged in sections with aisles and rows. The chairs making up these seating arrangements are usually set very close together leaving little or no room between spectators. Moreover, in some instances, these are temporal seating arrangements set with collapsible folding chairs.

While viewing a particular event, there is typically a desire to consume food or drink. However, with the tight seating arrangements, there is usually no room for safe, temporary placement of food or drinks. Spectators commonly have to hold their food and drink, making it difficult to applaud or otherwise participate in the activities without the risk of spilling or dropping their food and drink on themselves or the floor. Alternatively, one's food or drink may be placed on the floor; however, this is not desirable because of the generally dirty conditions found at stadium facilities.

There have been prior attempts to solve the aforementioned problems, but none have done it all, particularly in the same or similar fashion as the instant invention. For instance, these prior attempts include seats with article carriers underneath designed for storage, and cannot be used to securely hold articles, such as beverage containers, in a manner that may be readily accessed for consumption while viewing a particular event.

In other prior attempts, that do include seats with article carriers that hold articles in manner that may be accessed for consumption while viewing the particular event, all tend to fail to accommodate different seating styles of individual spectators. For example, the article holder extends out only centrally from underneath the seat. In some instances, these article holders tend to be bulky and large and, thus, leaving little room for one to move their legs without spilling food or drink. Overall, these devices tend to be uncomfortable and inconvenient, especially for women desiring to wear dresses, skirts and the like. Furthermore, these prior devices tend to be self-contained seating assemblies that are not capable of being readily used in conjunction with seating that is already in existence.

An object of the present invention is to provide an article holder apparatus that is capable of moving to different locations underneath the seat portion of the seating assembly to accommodate different seating styles of a spectator.

Another object of the present invention is to provide an article holder apparatus that is sized appropriately to make seating comfortable and convenient.

Another further object of the present invention is to provide an article holder apparatus which may be affixed to seating already in existence.

An even further object of the present invention is to provide an article holder apparatus having all the above-mentioned objects which is highly durable, efficient and cost effective to manufacture and install and easy to use.

Other objects of the invention are discussed below and are shown in the figures.

SUMMARY OF THE INVENTION

In accordance with the present invention, there is provided an article holder apparatus for use with a seating assembly, such as a chair. In the preferred embodiment, the article holder apparatus includes a mounting plate for attachment to the underside of the seating assembly's seat portion. At least one guide is mounted to the mounting plate to support a carriage at a location adjacent the mounting plate for movement in a first path. The carriage supports an article holder for movement in a second path transverse to the first path. The article holder includes an article receiver to hold an article. The article holder assembly of the present invention may be used with existing seating assemblies.

More specifically, the at least one guide may include a first pair of guide rails for supporting the carriage for movement in the first path. The carriage may include a second pair of guide rails for supporting the article holder for movement in the second path. The first pair of guide rails may be generally perpendicular to the second pair of guide rails. In the second path direction, the article holder moves between a retracted position with the article holder located generally beneath the seat bottom and an article holding extended position with the article holder extending generally outward from underneath the seat bottom so that the article receiver may hold an article.

The article holder may also include a stop, and the carriage may include a stop bar extending between the second pair of guide rails. The stop abuts the stop bar to limit movement of the article holder in the second path to a predetermined position outwardly from underneath the seat bottom. The article holder receiver defines an aperture for holding an article in a predetermined orientation. This aperture may be sized to hold an article, such as a beverage container, in an upright orientation.

The article apparatus assembly of the present invention may be used with a seating assembly, such as a folding chair that has a seat pivotable between a first position in which the seat has a substantially vertical orientation for nonuse, and a second position in which the seat has a substantially horizontal orientation for sitting thereon. In the second position, the article holder may be in its extended position for use, and by pivoting the seat to the first position, the article holder slides to the retracted position for nonuse.

The seat bottom surface may also include a pair of sides spaced a predetermined distance apart. The carriage may include a pair of longitudinally extending parallel rails which are spaced a predetermined distance apart. The article holder is then slidably mounted on the carriage rails for movement between the retracted and extended positions. The predetermined spacing of the seat bottom surface sides may be greater than the predetermined spacing of the carriage rails. The at least one rail may also include a front rail and a back rail in which the front and back rails are spaced laterally to support the carriage rails so that the carriage rails side over the front and back rails for sliding the carriage to a plurality of different positions beneath the seat.

BRIEF DESCRIPTION OF THE DRAWINGS

The present invention will be described in connection with the accompanying drawings wherein.

DETAILED DESCRIPTION OF THE PREFERRED EMBODIMENT

Figure 1:
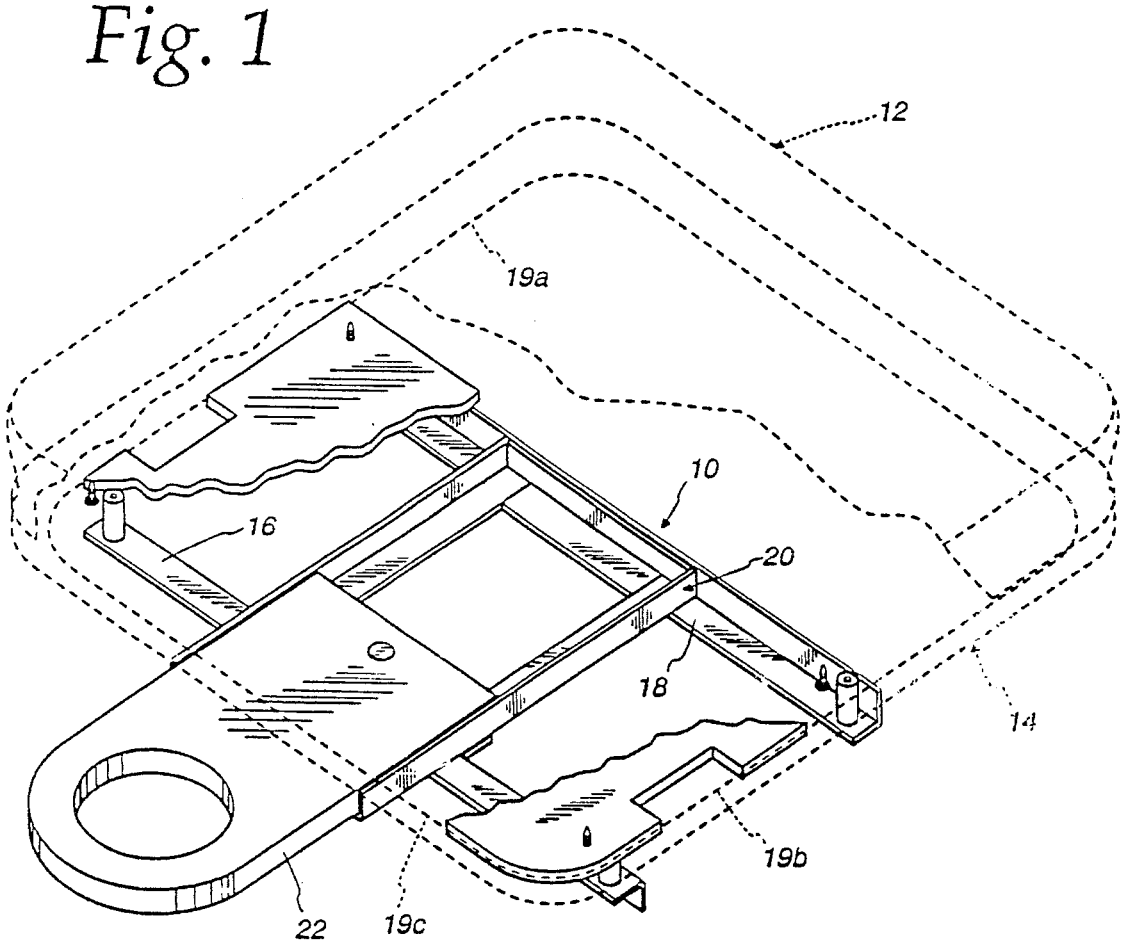
FIG. 1 is a perspective view of an underseat article holder apparatus embodying the present invention shown in conjunction with a seat illustrated in phantom and partially cut away.

Referring to FIG. 1 of the drawings, there is illustrated one example of the present invention in the form of an underseat article holder apparatus 10 attached to a seat 12 at its underside 14. In general, the apparatus 10 includes a front rail 16 and a rear rail 18 extending between a pair of parallel side edges 19*a*, 19*b* of the underside 14 of the seat 12. The rails 16, 18 support a carriage 20 for lateral movement across the underside 14 of the seat 12. The front rail 16 is located adjacent a front edge 19*c* of the underside 14 of the seat 12 and is forward of the rear rail 18 a predetermined distance. The carriage 20 includes an article holder arm 22 capable of moving between a retracted position for nonuse (FIG. 6), such as for storage, and an extended position for use (FIG. 7) to hold an article (not shown), such as a beverage cup. Due to the lateral movement capability of the carriage 20, the article holder arm 22 may be placed at a number of different positions beneath the seat. This enables one, for instance, to locate the article holder arm 22 on either side of one's legs, as well as between one's legs, while using the seat 12. Also, the article holder arm 22 is sized appropriately to avoid being bulky so as to provide comfort.

Figure 2:
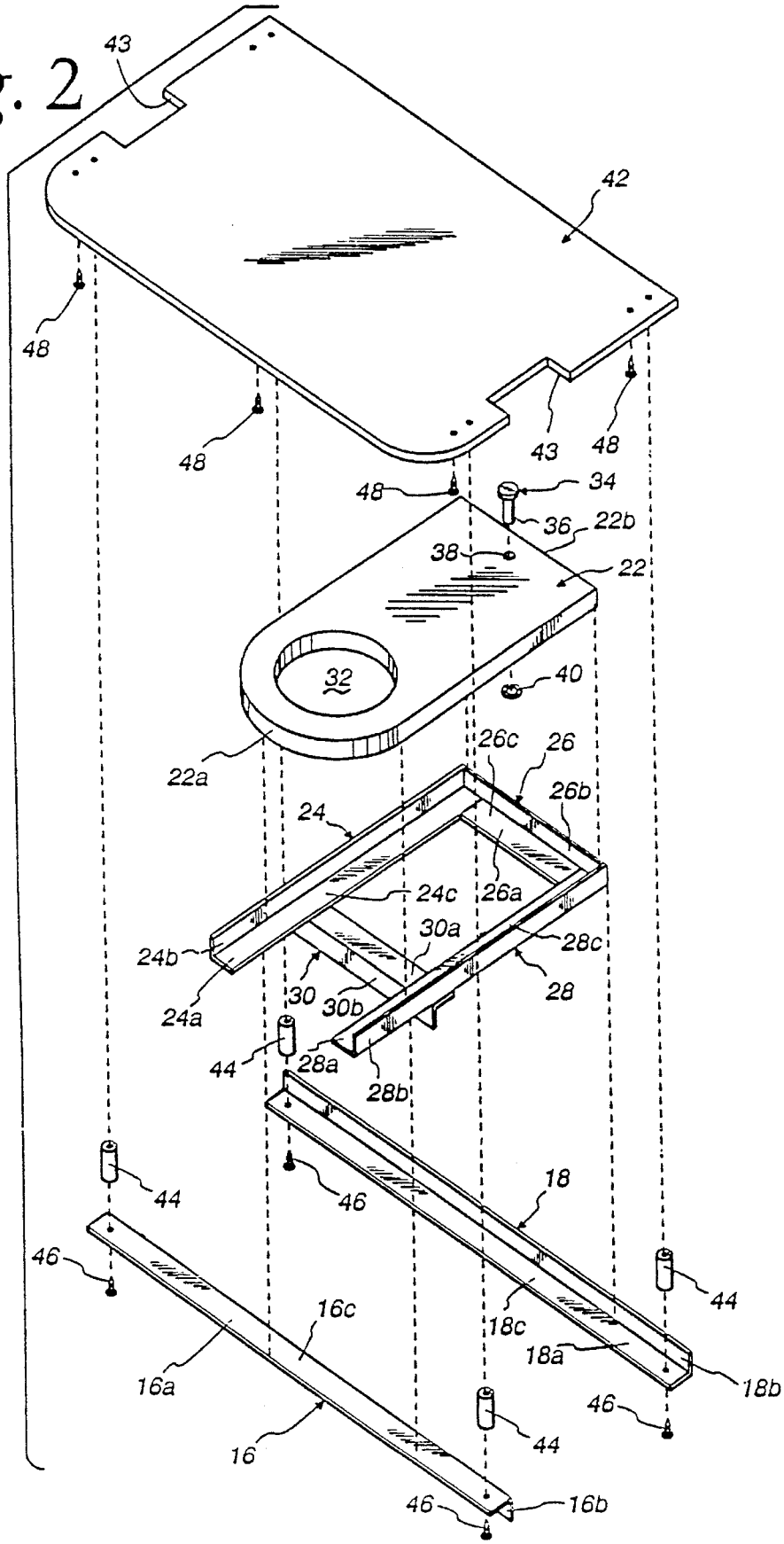
FIG. 2 is an exploded perspective view of the underseat article holder apparatus of FIG. 1.

Referring now to FIG. 2, both the front and rear rail 16, 18 each include a horizontal leg 16*a*, 18*a*, respectively, and an adjoining vertical leg 16*b*, 18*b*, respectively. The legs give each rail 16, 18 an L-shaped transverse cross-section which aids in the resistance to deflection. Both rails 16, 18 open forward toward the front edge 19*c* of the underside 14 of the seat 12, but the vertical leg 16*b* of the front rail 16 points downward and the vertical leg 18*b* of the rear rail 18 points upward. The horizontal legs 16*a*, 18*a*, of the front and rear rails 16, 18, respectively, support the carriage 20, and the carriage 20 slides over an upper surface 16*c*, 18*c* of these legs 16*a*, 18*a*, respectively, in moving laterally between the side edges 19*a*, 19*b* (FIG. 1) of the underside 14 of the seat 12. The rails may be made of any rigid material that sufficiently resists reflection. Such material may include any variation of metal, plastic, wood or any other like material.

The carriage 20 has a left frame member 24, a rear frame member 26 and a right frame member 28. The frame members 24, 26, 28 are joined in generally a "U" shape as viewed in top plan, and each frame member 24, 26, 28 includes a horizontal leg 24*a*, 26*a*, 28*a*, respectively, and a vertical leg 24*b*, 26*b*, 28*b*, respectively. These legs give each frame member 24, 26, 28 an L-shaped transverse cross-section. The frame members 24, 26, 28 open with the horizontal legs 24*a*, 26*a*, 28*a* directed inward toward one another to support the article holder arm 22 and the vertical legs 24*b*, 26*b*, 28*b* directed upward to restrict against lateral movement of the article holder arm 22.

More specifically, the frame members 24, 26, 28 only allow the article holder arm 22 to slide over upper surfaces 24*c*, 26*c*, 28*c* of the horizontal legs 24*a*, 26*a*, 28*a*, respectively, to move between a retracted, nonuse position (FIG. 6) in which the article holder arm 22 is substantially within the carriage 20 and an extended, use position (FIG. 7) in which the article holder arm 22 is extended beyond the seat 12 for use. The movement of the article holder arm 22 is generally perpendicular to the lateral movement of the carriage 20.

Figure 4:
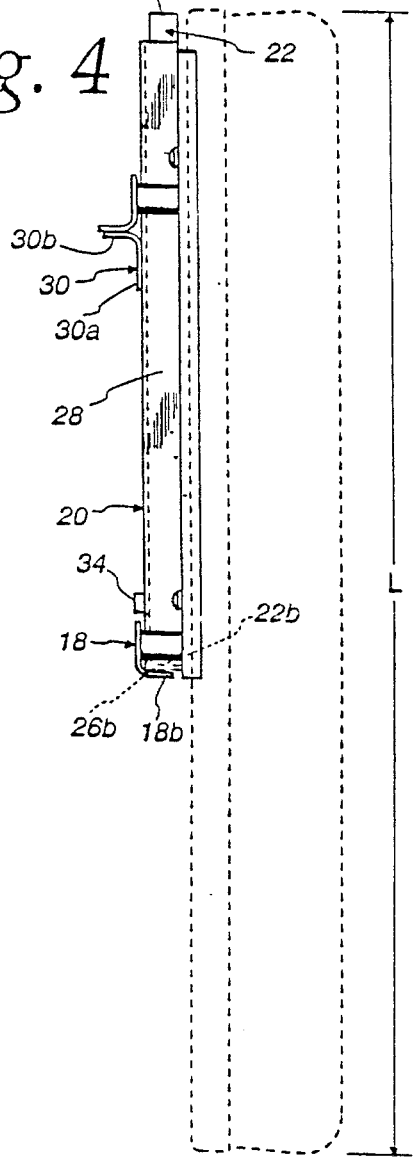
FIG. 4 is a side elevational view of the underseat article holder apparatus and seat of FIG. 1.
Figure 5:
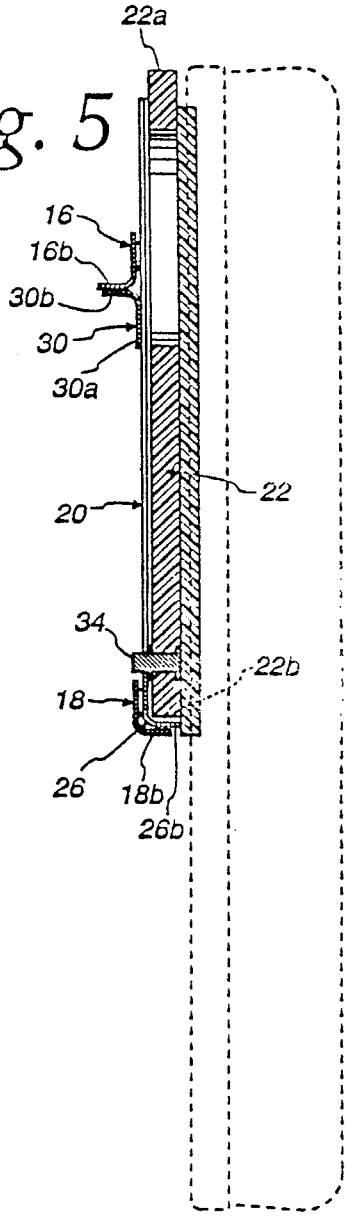
FIG. 5 is a cross-sectional view of the underseat article holder apparatus and seat taken along line 5—5 of FIG. 6.

Referring to FIGS. 2, 4 and 5, the vertical leg 26*b* of the rear frame member 26 of the carriage 20 also engages the vertical leg 18*b* of the rear rail 18 to prohibit the carriage 20 from moving backward in a direction perpendicular to the lateral movement of the carriage 20. The carriage 20 also includes a front frame member 30 extending between the left frame member 24 and the right frame member 28.

More specifically, the front frame member 30 has a horizontal leg 30*a* and a vertical leg 30*b*. The legs 30*a*, 30*b* give the frame member 30 a L-shaped transverse cross-section, which adds to deflection resistance. The horizontal leg 30 is affixed to the underside of the horizontal legs 24*a*, 28*a* of the left and right frame members 24, 28, respectively, so that it opens backward toward the carriage 20 and the vertical leg 30*b* points downward. The vertical leg 30*b* slidably engages the vertical leg 16*b* of the front rail 16 to prohibit the carriage 20 from moving forward in the direction perpendicular to the lateral movement of the carriage 20. The carriage frame members may be made from any rigid material that sufficiently resists reflection and may be affixed together in any secure manner, such as welds, screws, bolts or glue. Such rigid material may include any variation of metal, plastic, wood or any other like material.

The article holder arm 22 of the carriage 20 has a rectangular plate-like configuration with a front end 22*a* and a rear end 22*b*. As illustrated, the front end 22*a* is rounded, and adjacent thereto the article holder arm 22 defines an aperture 32 sized to hold an article (not shown), such as a beverage container in an upright orientation. The article holder arm 22, located adjacent the rear end 22*b*, includes a stop 34 which aids in preventing the article holder arm 22 from being removed from the carriage 20. The stop 34 consists of a pin 36 extended through a hole 38 defined by the article holder arm 22 and secured with a lock washer 40. The pin may be made from any durable material, such as metal, plastic or the like.

Figure 3:
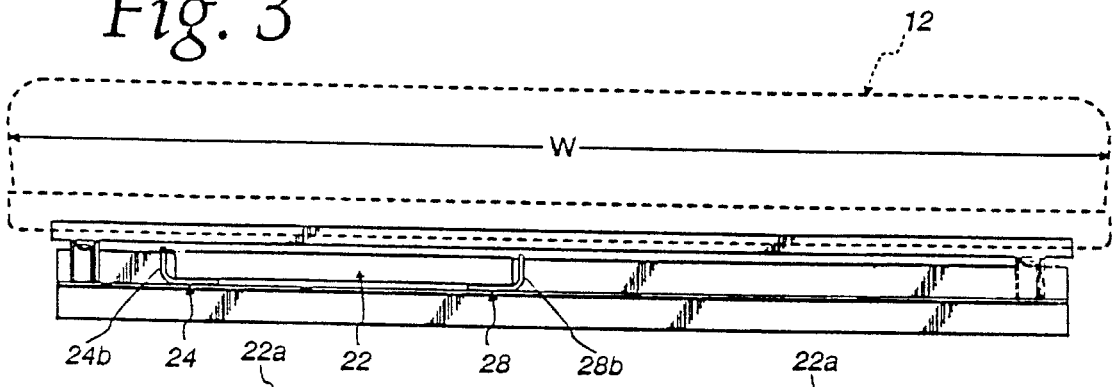
FIG. 3 is an elevational view of the underseat article holder apparatus and seat of FIG. 1.
Figure 7:
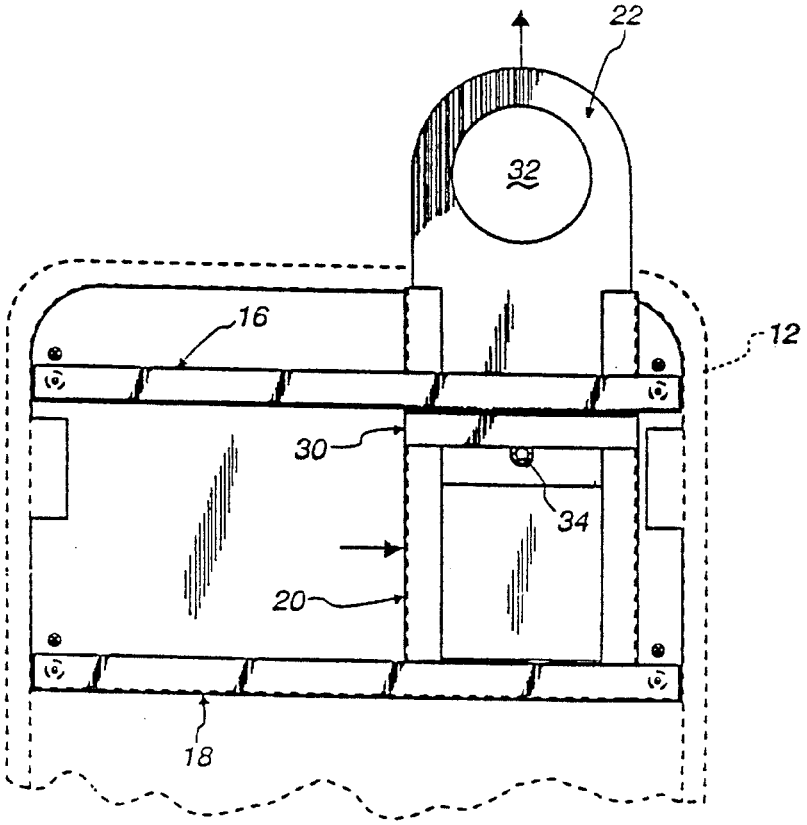
FIG. 7 is a bottom plan view of the underseat article holder apparatus and seat of FIG. 1 in which an article holder carriage is illustrated in a right, extended position.

When the article holder arm 22 is in the extended position, the stop 34 may engage the front frame member 30 to aid in preventing further unnecessary extension, and to prevent the article holder arm 22 from escaping the carriage 20 (FIG. 7). In the retracted position, the stop 34 may engage the rear frame member 26 to prevent further retraction. As best illustrated in FIGS. 3 and 4, the preferred thickness of the article holder arm 22 is slightly less than the height of the vertical legs 24*b*, 26*b*, 28*b* of the carriage frame members 24, 26, 28, respectively. And, the preferred width is less than the width "W" (FIG. 3) of the seat 12 so as not to be bulky and uncomfortable. The article holder arm 22 may be made from any suitable rigid material that resists deflection sufficient to support an article, such as a beverage container in an upright orientation without spillage. Such material may include metal, plastic, wood and the like.

As best illustrated in FIG. 2, the assembly 10 includes a mounting plate 42 used to secure the apparatus 10 to the underside 14 of the seat 12. More specifically, the rails 16, 18 are attached to the mounting plate 42 through four spacers 44 located at each of the ends of the rails 16, 18, and fasteners 46, such as rivets or screws, extending through the rails 16, 18, spacers 44, and the mounting plate 42. The spacers 44 limit the movement of the carriage 20 to prevent it from leaving the ends of the rails 16, 18 adjacent the side edges 19*a*, 19*b* of the underside 14 of the seat 12. The spacers 44 space the rails 16, 18 a sufficient distance from the mounting plate 42 to allow the carriage 20 to move freely over the rails 16, 18. Such spacing is also short enough to aid in maintaining the article holder arm 22 in the carriage 20, and to allow the carriage 20 to move freely between its use and nonuse positions.

The mounting plate 42 is secured to the underside 14 of the seat 12 using at least four fastener 48, such as screws, rivets, bolts and the like. The mounting plate 42 may include a number of cut outs 43 in order to provide access to fasteners (not shown) used to secure the seat 12 together. The mounting plate may be made from any suitable rigid material, such as any variation of metal, plastic, wood or the like.

Figure 6:
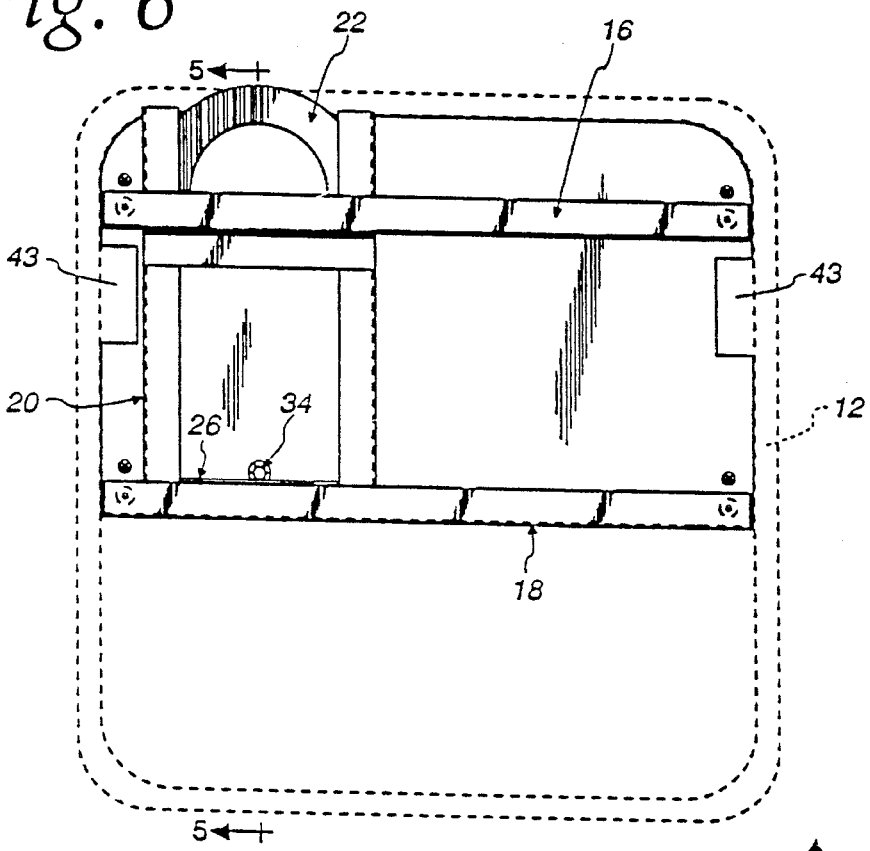
FIG. 6 is a bottom plan view of the underseat article holder apparatus and seat of FIG. 1 in which an article holder carriage is illustrated in a left, retracted position.

Referring to FIG. 6, the carriage 20 is shown at its far left position on the rails 16, 18, as viewed in a bottom plan view. Also, the article holder arm 22 is shown in the nonuse position in which the entire arm 22 is generally retracted underneath the seat 12 in the carriage 20. In the illustrated nonuse position, the stop 34 engages the rear frame member 26 of the carriage 20.

Referring to FIG. 7, the carriage 20 is now shown at its far right position on the rails 16, 18, as viewed in a bottom plan view. Also, the article holder arm 22 is shown in the use position in which the arm 22 is extended generally from the carriage 20 so that the aperture 32 for holding an article is out beyond the seat 12. In the illustrated use position, the stop 34 engages the front frame member 30 of the carriage 20. Further, in the illustrated use position, it is readily appreciated that one may position their legs to the left of the article holder arm 22. In addition to the positions illustrated in FIGS. 6 and 7, the carriage 20 may be positioned anywhere in between the far left and right positions, such as at a center position, as illustrated in FIG. 8.

Figure 8:
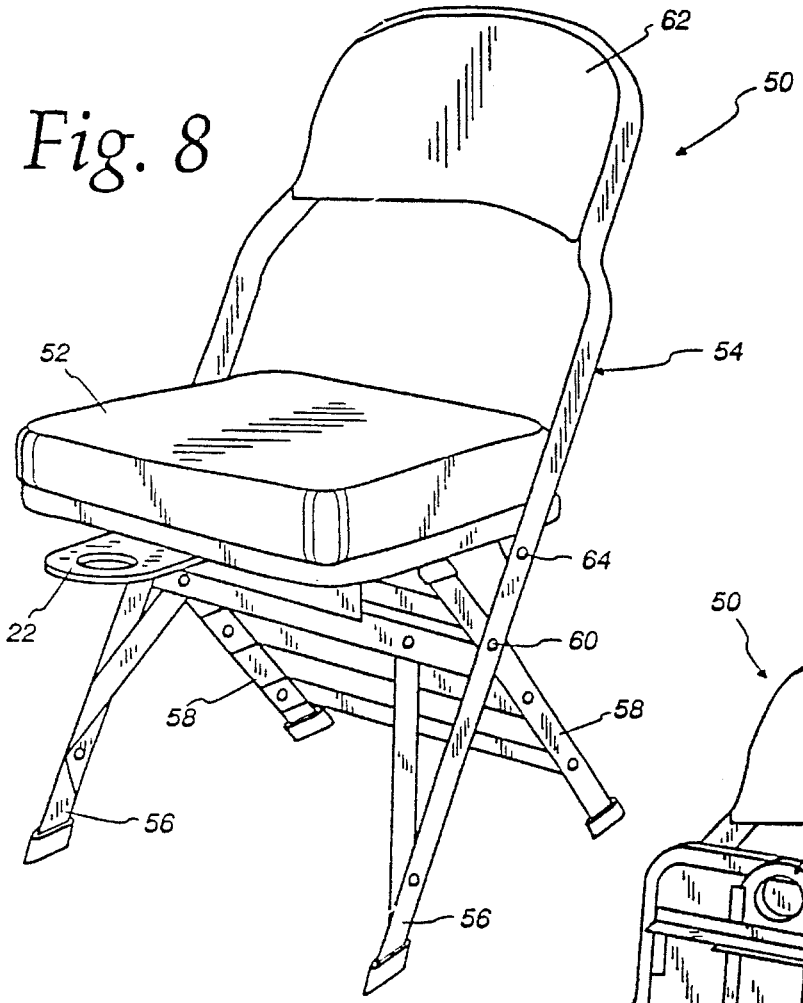
FIG. 8 is a perspective view of the article holder apparatus of FIG. 1 shown in conjunction with a folding chair having its seat in a use position.
Figure 9:
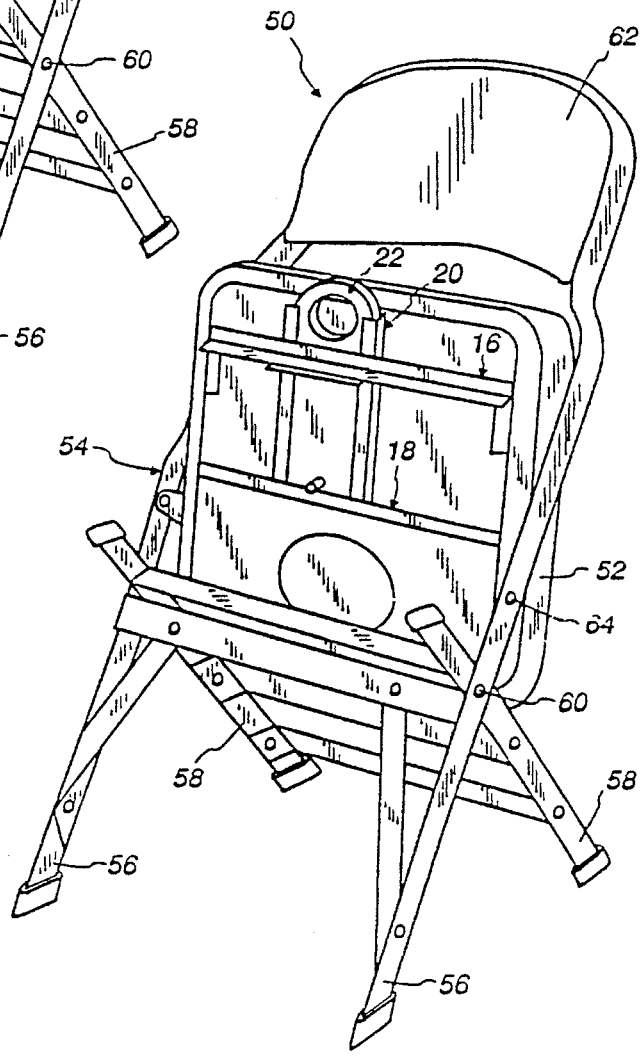
FIG. 9 is a perspective view of the article holder apparatus of FIG. 1 shown in conjunction with a folding chair have its seat in a nonuse position.

Referring now to FIGS. 8 and 9, the article holder apparatus 10 may be used in conjunction with a folding chair 50 having a seat 52 similar to that of the above-described seat 12. As illustrated, the folding chair 50 has a chair frame 54 with at least two front legs 56 and two rear legs 58. Each front leg 56 is mounted to a rear leg 58 with pivot connection 60, enabling the legs 56, 58 to fold together for storage. When the chair 50 is unfolded for use, each pair of the connected front and rear legs 56, 58 cross one another generally like the letter "X".

Further with respect to the unfolded use position, each of the front legs 56 angle upward and backward to support a backrest 62, and each of the rear legs 58 angle upward and forward to support the underside of the seat 52. The seat 52 is mounted to the frame 54, e.g., the rear legs 58, with a pivot connection 64 that enables the seat 52 to be moved between a horizontal use position (FIG. 8) and a vertical storage position (FIG. 9). As illustrated, the seat 52 is able to pivot independent of any movement of the legs 56, 58. Alternatively, the seat 52 may be connected for movement with the legs of a chair.

With the seat in the horizontal use position, one may pull out the article holder arm 22 from the carriage 20 to store an article, such as a beverage container, and one may slide the carriage 20 left or right over the rails 16, 18 to position the article holder arm 22 to the left or right of one's body, or anywhere in between, such as in the center. In addition, when the seat 52 is pivoted upward to the vertical position, the article holder arm 22 automatically retracts under gravity into the carriage 20, as illustrated in FIG. 9.

On example of an article holder assembly may have the following dimensions for use with a chair seat having a width "W" (e.g., FIG. 3) in a range of approximately 16.5 inches (in.) to 17 in. and a length "L" (e.g., FIG. 4) in a range of approximately 15.25 in. to 15.75 in. With this chair seat, the mounting board may have width in the range of about 15 in. to 15.5 in. and a length in the range of about 8.25 in. to 8.75 in. The rails may have a length in the range of approximately 14.75 in. to 15.25 in. with the front rail being located in the range of approximately 2.25 in. to 3.75 in. from the front edge of the chair and the rear rail being located in the range of approximately 8.25 in. to 8.75 in. from the front edge of the chair. The horizontal leg of the rails may be in the range of about 0.75 in. to 1 in., and the vertical leg may be in the range of about 0.375 in. to 0.625 in.

The carriage may have a width in the range of about 4.5 in. to 5 in. and a length in the range of 8.25 in. to 8.75 in. The horizontal leg of the carriage frame members may be in the range of about 0.75 in. to 1 in., and the vertical leg of the carriage frame members may be in the range of about 0.375 in. to 0.625 in. The width of the article holder arm may be in the range of approximately 4.25 in. to 4.75 in. and the length may be in the range of approximately 8.5 in. to 9 in. The stop at the rear of the article support may be located in the range of approximately 0.25 in. to 0.75 in. from the rear edge of the arm. The article holder aperture may have a diameter in the range of approximately 2.75 in. to 3.25 in. The spacers used to space the rails from the mounting plate may be in the range of approximately 0.375 in. to 0.625, but in any event must be slightly greater than the vertical leg of the carriage frame members. Of course, these dimensions vary depending on the size of the chair seat, as well as other conditions and combinations.

It will be understood that various changes in the detail, materials and arrangement of pans and assemblies which have been herein described and illustrated in order to explain the nature of the present invention may be made by those skilled in the an within the principle and scope of the present invention as expressed in the appended claims.

What is claimed is:

1. A seating apparatus comprising:

a seat having a bottom surface, the seat bottom surface having a pair of spaced sides;

at least one rail mounted to the seat bottom surface and extending primarily between the spaced sides of the seat bottom surface;

a carriage supported for sliding movement by the at least one rail to allow the carriage to slide over the at least one rail to a plurality of different positions beneath the seat and laterally between the spaced sides of the seat bottom surface; and an article holder carried by the carriage having an article receiver and being movable between a retracted position with the article receiver residing beneath the seat and an extended position with the article receiver extending outwardly from beneath the seat.

2. The seating apparatus of claim 1 wherein the article holder includes a stop member and the carriage includes a frame having an intermediate stop engaging portion to limit the travel of the article holder in the extended position to a predetermined outwardly extending position relative to the seat by abutment of the stop member with the stop engaging portion.

3. The seating apparatus of claim 1 wherein the pair of spaced sides have a first predetermined spacing therebetween and the carriage includes a pair of longitudinally extending parallel rails having a second predetermined spacing therebetween with the article holder slidably mounted between the carriage rails for movement between the retracted and extended positions and the first spacing being greater than the second spacing.

4. The seating apparatus of claim 3 wherein the at least one rail includes a front rail and a back rail, the front and back rails being spaced to support the carriage rails, the carriage rails sliding over the front and back rails for sliding the carriage to the plurality of different positions beneath the seat.

5. The seating apparatus of claim 1 wherein the article receiver defines an aperture sized to hold an article in a predetermined orientation.

6. The seating apparatus of claim 5 wherein the article is a beverage container and the aperture is sized to hold the beverage cup in the predetermined orientation, the predetermined orientation being in an upright position.

7. A seating apparatus comprising:

a seat having a bottom surface;

at least one rail mounted to the seat bottom surface;

a carriage supported for sliding movement by the at least one rail to allow the carriage to be moved to a plurality of different positions beneath the seat;

an article holder carried by the carriage having an article receiver and being movable between a retracted position with the article receiver residing beneath the seat and an extended position with the article receiver extending outwardly from beneath the seat; and the seat being pivotable between a first position with the seat having a substantially vertical orientation, and a second position with the seat having a substantially horizontal orientation for sitting thereon, and wherein with the seat in the second position and the article holder in the extended position, pivoting of the seat to the first position causes the article holder to slide to the retracted position.

8. A seating apparatus comprising:

a seat having laterally spaced sides;

guide mounted to the seat and extending primarily between the laterally spaced sides underneath the seat;

a carriage supported by the guide for movement in a first linear path between the laterally spaced sides and underneath the seat; and a receptacle holder supported by the carriage for movement in a second linear path transverse to the first path, the first and second paths being substantially in a single general plane extending underneath the seat.

9. The seating apparatus of claim 8 wherein the second path is generally perpendicular to the first path.

10. The seating apparatus of claim 8 wherein the seat includes a substantially flat bottom surface and the guide includes a pair of longitudinally spaced rails extending between the laterally spaced sides and spaced from the bottom surface with the carriage mounted between the rails and the bottom surface for movement in the first path.

11. The seating apparatus of claim 10 wherein the carriage comprises a frame having a pair of spaced legs and a base, the receptacle holder comprises a substantially planar elongate member located between the spaced legs of the carriage and the substantially planar elongate member moves along the spaced legs in the second path.

12. A seating apparatus comprising:

a seat having laterally spaced sides;

a guide mounted to the seat;

a carriage supported by the guide for movement in a first path between the laterally spaced sides; and a receptacle holder supported by the carriage for movement in a second path transverse to the first path;

the seat includes a substantially flat bottom surface and the guide includes a pair of longitudinally spaced rails extending between the laterally spaced sides and spaced from the bottom surface with the carriage mounted between the rails and the bottom surface for movement in the first path;

the carriage comprising a frame having a pair of spaced legs and a base, the receptacle holder comprises a substantially planar elongate member located between the spaced legs of the carriage and the substantially planar elongate member moves along the spaced legs in the second path; and the substantially planar elongate member comprising a forward end and a rearward end, the forward end adapted to hold an article, the substantially planar elongate member further being movable between a retracted position with the receptacle holder generally beneath the bottom surface of the seat and the rearward end being adjacent to the frame of the carriage, and an extended position with the forward end extending outwardly from beneath the bottom surface of the seat to expose the receptacle holder forward end to hold an article, and the rearward end being spaced from the frame of the carriage.

13. The seating apparatus of claim 12 wherein the substantially planar elongate member includes a stop member intermediate the forward and rearward ends thereof and the frame of the carriage includes a web spanning the spaced legs located from the base to limit the movement of the substantially planar elongate member in the second path to a predetermined outwardly extending position with the stop member abutting the web.

14. A article holder apparatus for use with a seating assembly having a seat bottom, the article holder apparatus comprising:

a mounting plate for attachment to a seat bottom, the mounting plate having a pair of spaced sides;

at least one guide mounted fixedly to the mounting plate and extending primarily between the spaced sides of the mounting plate;

a carriage supported by the at least one guide at a location adjacent the mounting plate for movement in a first direction between the spaced sides of the mounting plate; and an article holder carried by the carriage and supported for movement in a second direction transverse to the first direction.

15. The article holder apparatus of claim 14 wherein the article holder is movable in the second direction between a retracted position with the article holder located beneath a seat bottom and an article holding extended position with the article holder extending outwardly from underneath a seat bottom, the first and second directions being in substantially a single general plane.

16. The article holder apparatus of claim 15 wherein the article holder defines an aperture for holding an article in a predetermined orientation.

17. The article holder apparatus of claim 16 wherein the aperture is sized to hold a beverage container in an upright orientation.

18. The article holder apparatus of claim 14 wherein the first direction is substantially perpendicular to the second direction.

19. The article holder apparatus of claim 14 wherein the first and second directions are linear transverse directions to one another.

20. The article holder apparatus of claim 19 wherein the first and second directions are substantially perpendicular to one another.

21. A article holder apparatus for use with a seating assembly having a seat bottom, the article holder apparatus comprising:

a mounting plate for attachment to a seat bottom;

at least one guide mounted to the mounting plate;

a carriage supported by the at least one guide at a location adjacent the mounting plate for movement in a first direction;

an article holder carried by the carriage and supported for movement in a second direction transverse to the first direction; and the at least one guide includes a first pair of guide rails for supporting the carriage for movement in the first direction and the carriage includes a second pair of guide rails for supporting the article holder for movement in the second direction with the first pair of guide rails being generally perpendicular to the second pair of guide rails.

22. The article holder apparatus of claim 21 wherein said article holder includes a stop member and the carriage includes a stop engaging bar extending between the second pair of guide rails to limit movement of the article holder in the second direction to a predetermined position outwardly from a seat bottom by abutment of the stop member with the stop engaging bar.

* * * * *